US005408858A

United States Patent [19]

Fukuda

[11] Patent Number: 5,408,858

[45] Date of Patent: Apr. 25, 1995

[54] BENDING MACHINE UTILIZING CONTROLLED EXPANDABLE PRESSURE DEVICE TO APPLY UNIFORM PRESSURE TO WORK MATERIAL

[75] Inventor: Etsuo Fukuda, Cerritos, Calif.

[73] Assignee: Amada Engineering & Service Co., Inc., La Mirada, Calif.

[21] Appl. No.: 185,395

[22] Filed: Jan. 24, 1994

[51] Int. Cl.[6] ..... B21D 5/01

[52] U.S. Cl. ..... 72/389; 72/446; 72/465; 72/481

[58] Field of Search ..... 72/389, 446, 448, 437, 72/465, 473, 481, 702

[56] References Cited

U.S. PATENT DOCUMENTS

| | | | |
|---|---|---|---|
| 4,016,742 | 4/1977 | Shiokawa | 72/465 |
| 4,106,323 | 8/1978 | Haenni et al. | 72/448 |
| 4,131,008 | 12/1978 | Malatto | 72/389 |
| 4,653,307 | 3/1987 | Zbornik | 72/389 |
| 4,966,029 | 10/1990 | Zbornik | 72/389 |
| 5,067,340 | 11/1991 | MacGregor | 72/389 |

FOREIGN PATENT DOCUMENTS

| | | | |
|---|---|---|---|
| 1399308 | 7/1975 | United Kingdom | 72/448 |

*Primary Examiner*—David Jones
*Attorney, Agent, or Firm*—Irving Keschner

[57] ABSTRACT

A bending machine having an upper punch containing portion, or beam, and a lower die containing portion, or beam, is modified by incorporating a controlled expandable pressure device whereby the pressure applied to a work material is uniformly distributed throughout the surface of the material. In a first embodiment, the device is mounted in the upper and lower machine portions; in a second embodiment, the device is mounted only in the upper machine portion; in a third embodiment, the device is mounted only in the lower machine portion; and in a fourth embodiment, segmented devices are mounted in the upper machine portion and a single, elongated device is mounted in the lower machine portion.

4 Claims, 8 Drawing Sheets

FIG. 10
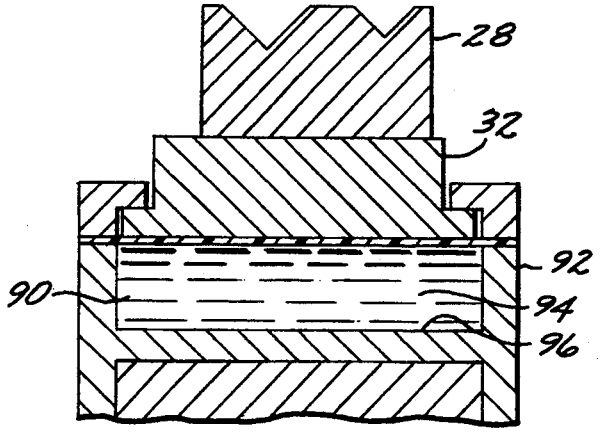
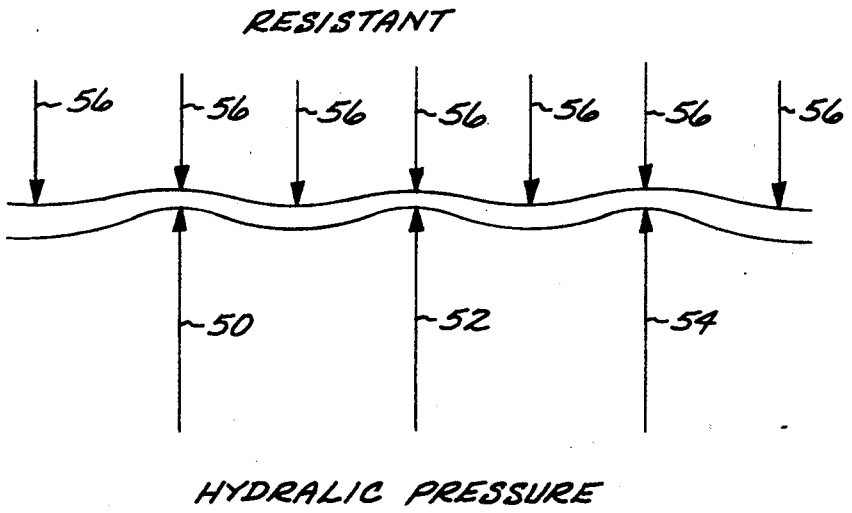
FIG. 11 PRIOR ART
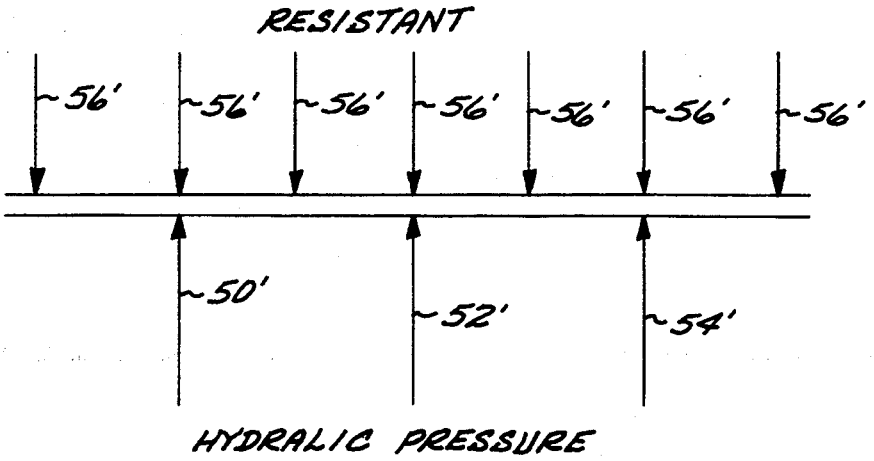
FIG. 12

BENDING MACHINE UTILIZING CONTROLLED EXPANDABLE PRESSURE DEVICE TO APPLY UNIFORM PRESSURE TO WORK MATERIAL

BACKGROUND OF THE INVENTION

1. Field of the Invention

The present invention relates to bending machines and, in particular, to bending machines which utilize expandable controlled pressure devices to distribute the bending pressure uniformly over the surface of the work material.

2. Description of the Prior Art

Sheet metal processing utilizing machines that automatically bend sheet metal have been available in the prior art for many years. For example, the Amada Company, Ltd., Kanagawa, Japan manufactures machines of this type which have many enhanced features such as sectionalized punch holders and a lower beam that moves on pre-loaded bearing guide blocks rather than on conventional friction guides. Although these and similar machines have significantly advanced sheet metal processing technology, one of the problems frequently encountered is that the pressure applied to the work material is not uniform, resulting in fabricated parts which do not conform to the required shape. The non-uniformity in applied pressure is due, in part, to the use of fluid controlled hydraulic pistons to move the lower beam into contact with the tool containing portion of the machine.

In addition, if a piston fails because of leaking in the "O"ring, the entire bending process will be interrupted until the failed piston is repaired or replaced, increasing production costs.

U.S. Pat. No. 4,202,264 to Hausman discloses the use of an inflatable pressure container to transfer power to a ram in a hydraulic press without the necessity of using conventional piston seals and gaskets, and in addition, which provides a uniform pressure over its operating surface.

What is desired is to provide a bending machine which avoids the disadvantages inherent in using a hydraulic cylinder based pressure system by utilizing instead the uniform pressure capabilities of an inflatable pressure container.

SUMMARY OF THE PRESENT INVENTION

The present invention provides an improved bending machine by enabling the pressure applied to the work material to be uniformly distributed throughout the surface of the material. In particular, the conventional bending machine, which has an upper punch containing beam portion and a lower die containing beam portion, is modified, in a first embodiment, by mounting a controlled expandable pressure device in both the upper and lower beam portions. Controlled expandable pressure devices, in essence, comprise an enclosed, elongated container wherein fluid, gas or gel material is pumped therein under pressure, one surface of the member being adapted to expand to an extent dependent upon the material and the pressure applied thereto, the surface in turn contacting, directly or indirectly, the work material. By controlling the force applied to the surface of the expandable member, the overall force applied to the work material, in turn, is substantially uniform, thereby providing a relatively smooth material bend. In a second embodiment, the device is mounted only in the upper beam portion and in a third embodiment, the device is mounted only in the lower beam portion; in a third embodiment the device is mounted only in the lower machine portion and in a fourth embodiment, segmented devices are mounted in the upper machine portion and a single, elongated device is mounted in the lower machine portion.

The present invention thus provides a significant improvement over conventional bending machines by adapting a controlled expandable pressure device in automated bending machines thus providing a machine which processes sheet metal in a more accurate manner than heretofore available. The controlled expandable pressure device can be easily adapted for mounting within the existing machines in a cost efficient manner thus providing the added degree of flexibility parts fabricators seek.

BRIEF DESCRIPTION OF THE DRAWING

For a better understanding of the invention as well as other objects and further features thereof, reference is made to the following description which is to be read in conjunction with the accompanying drawing wherein;

FIG. 10 is a sectional view of another embodiment of a pressure application device adaptable for use in a bending machine;

FIG. 11 represents the typical forces applied to a metal piece being bent using a conventional bending machine;

FIG. 12 represents forces applied to a metal work piece bent by a bending machine modified to incorporate the controlled expandable pressure device shown in FIG. 6;

The same reference numerals used in the figures identify identical components.

DESCRIPTION OF THE INVENTION

Figure 1:
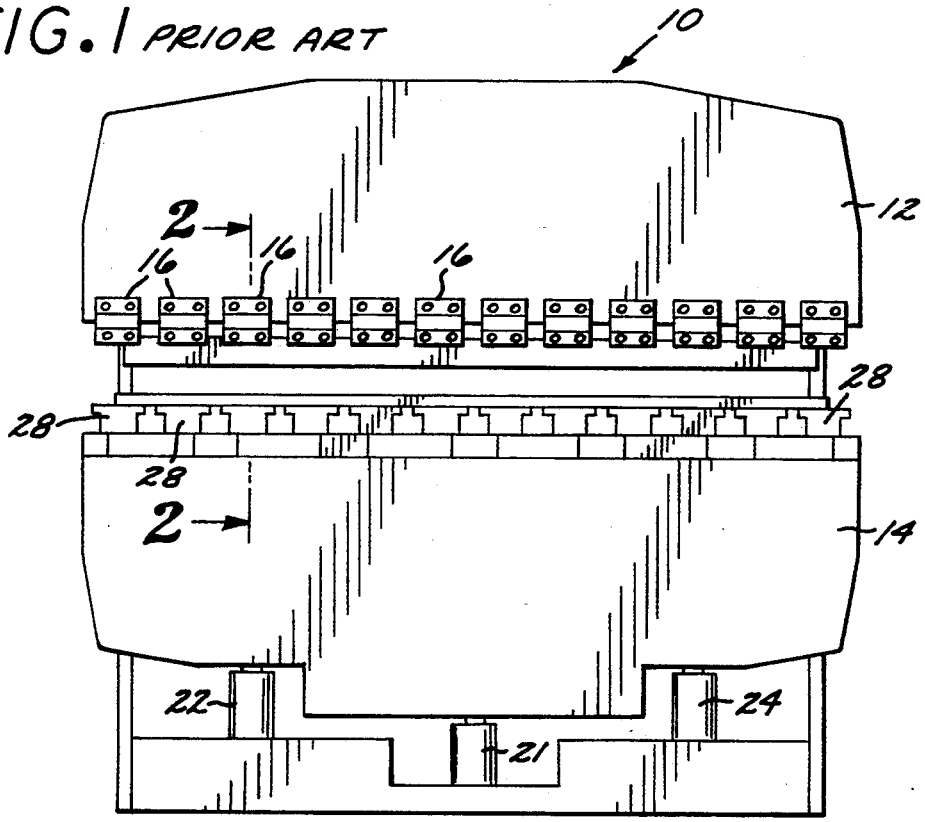
FIG. 1 PRIOR ART
FIG. 1 is a front view of a portion of a prior art bending machine.
Figure 2:
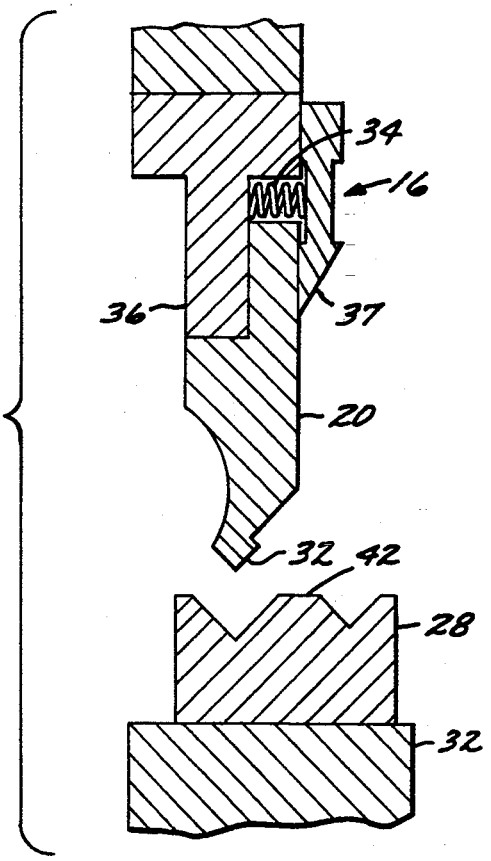
FIG. 2 PRIOR ART
FIG. 2 is a sectional view along line 2—2 of FIG. 1.

FIGS. 1 and 2 illustrate a prior art automated bending machine such as the Model No. RG 80 manufactured by the Amada Company, Ltd., Kanagawa, Japan. FIG. 1 illustrates a front view of such a machine 10 and comprises a stationary upper beam portion 12 and a moveable lower beam portion 14. As will be described in more detail hereinafter, a plurality of distance pieces, or holders, 16 are provided on upper beam portion 12 and are utilized to secure a bending tool, or punch, 20 shown in a sectional view in FIG. 2. A centrally located primary hydraulic cylinder 21 is provided to insure parallel beam defection and uniform bends to the extent available prior to the present invention. Outside hydraulic cylinders 22 and 24 assist in spreading the bending force evenly along the bend's length. Cylinders 20, 22 and 24 are positioned below the lower beam portion 14 and, as is well known, are utilized to move lower beam portion 14 towards or away from upper beam portion 12. In essence, controlling the movement and force applied to beam portion 14 by using cylinders 20, 22 and 24 controls the resulting pressure applied to a single elongated die 28 supported on elongated table 30 which, in turn, applies a force to the tip 32 of punch 20, sheet metal held in a die 28 being bent to a predetermined shape as is well known. FIG. 2 is a sectional view along line 2—2 of FIG. 1 and shows a view of the elongated tool 20 and the punch holder 16 which therefore to hold the tool 20 against support member 36. Each spring 34 in punch holder 16 is utilized to adjust wedge portion 37 of holder 16 to allow fine bending angle adjustments.

The bending operation is as follows: the sheet metal material 40 (see FIGS. 6 and 7) is interposed between the tip 32 of punch 20 and the top portion 42 of die 28, a controlled pressure being applied to the pistons 20, 22 and 24 such that the beam portion 14 moves towards punch 20 with a sufficient force such that the proper bend is formed in the sheet metal material 40. The amount of pressure applied to work material 40 by punch 20 is directly controlled by a computer apparatus controlling the fluid pressure applied to the cylinders 20, 22 and 24. As shown in FIG. 11, pressure applied by the hydraulic cylinders 20, 22 and 24 are represented by arrows 50, 52 and 54 respectively. The resistance force applied by the tool nose 30 in the opposite direction is represented by arrows 56. The sheet metal material 40 which is interposed between the tool nose 30 and the underlying die 28 is shown represented as being bent in an uneven manner even before the material is bent to the desired specification. In essence, the current conventional bending machines, although highly successful, still are unable to provide a substantially uniform pressure distribution over the material being worked.

Figure 3:
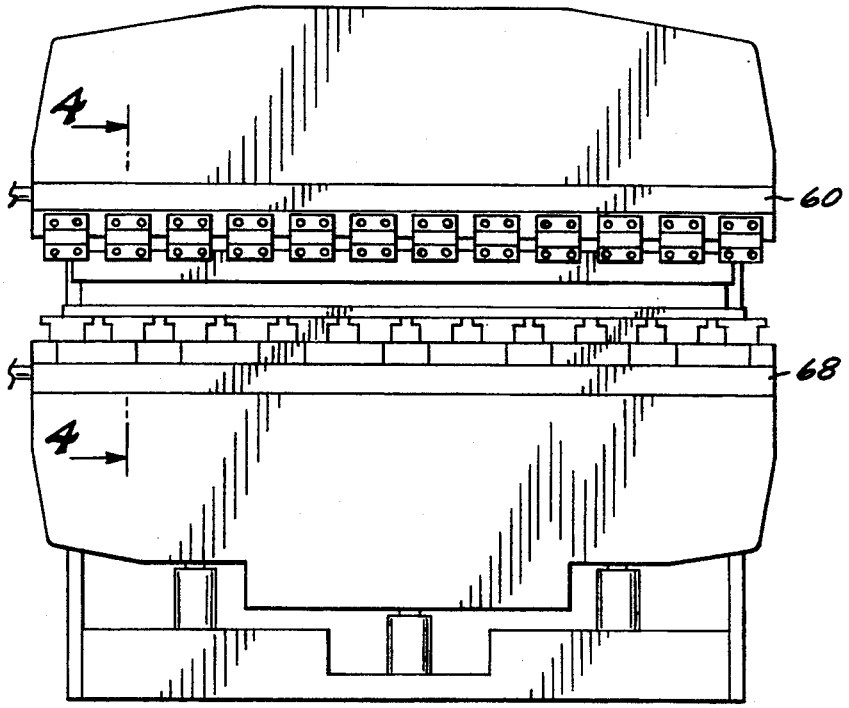
FIG. 3 is a front view of a portion of a bending machine using the controlled expandable pressure device of the present invention.
Figure 4:
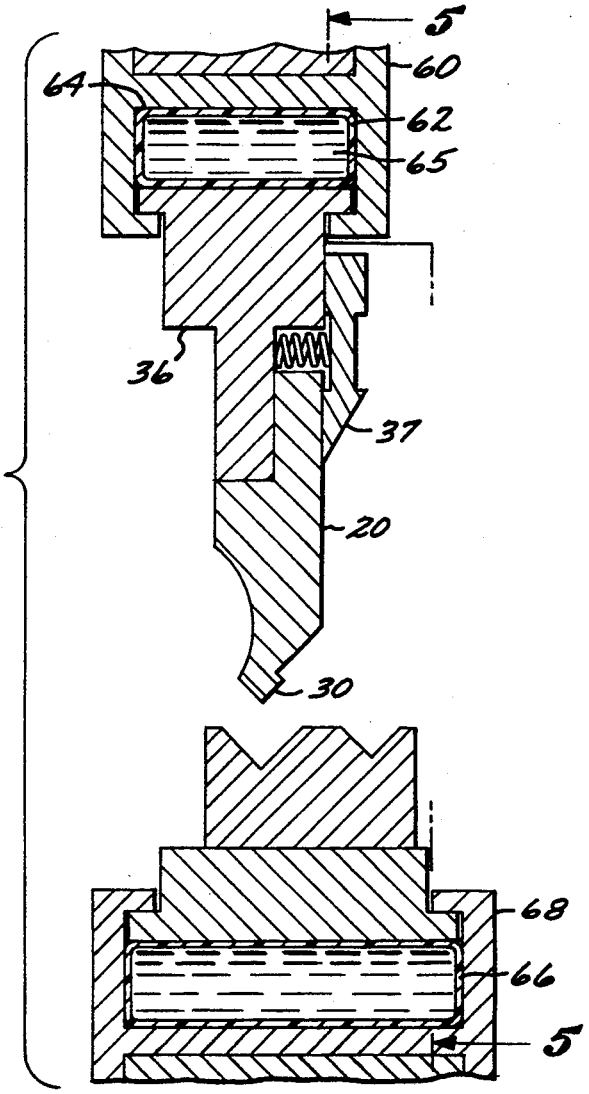
FIG. 4 is a view along line 4—4 of FIG. 3.

FIGS. 3 and 4 illustrate the embodiment of the present invention wherein a holder device 60 having a controlled expandable pressure 62 container therein generates surface tension, or bending pressure to provide a uniformly distributed bending pressure throughout the length of the sheet metal 40 being worked. In particular, referring to FIGS. 3 and 4, expandable container 62 is mounted in upper beam portion 12 in holder device 60 between surface 64 of holder member 60 and tool support member 36 to distribute the resistance force applied by the tool nose 30 to sheet material 40. Inflatable container 60 can be made from any type of elastomeric material commonly known to those skilled in the art and which can resist chemical or physical degradation when in contact with the pressure transfer material 65. In the preferred embodiment, the material has properties capable of resisting chemical or physical degradation when placed in intimate contact with heated hydraulic fluid, the preferred pressure transfer material. Hydraulic fuel may be an oil, an oil based derivative or a lubricating organic chemical. Specific polymers such as neoprene rubber may be used to successfully resist chemical and physical degradation. If the hydraulic fluid is aqueous, other types of container composition may be employed, recognizing the skill of those in the art to adapt and utilize the best composition. In addition, gas or gel may be used as pressure transfer material 65.

The container 62 must be made of a composition which not only resists chemical and physical degradation but provides adequate expansion and contraction properties sufficient to maintain its structural integrity over repeated hydraulic fluid operations. The size of the container 62 utilized in the bending machine is dependent upon the amount of expanded, pressurized movement desired. Expandable containers, such as container 62, have been available in the prior art, such as the device disclosed in U.S. Pat. No. 4,202,264.

In the FIG. 3 and 4 embodiment, an expandable container 66, identical to container 62, is also positioned in bottom beam portion 14 in a holder device 68 and below die table 32 as illustrated. In FIG. 12, a representation of the pressure forces 50', 52', 54' and 56' which are applied to working material 40 to overcome the resistance forces thereto using the embodiment of FIG. 3 is illustrated. In essence, bending machine frame distortion that causes the uneven bending pressure distribution shown in FIG. 11 is compensated for and eliminates the necessity of distance piece adjustments.

Figure 5:
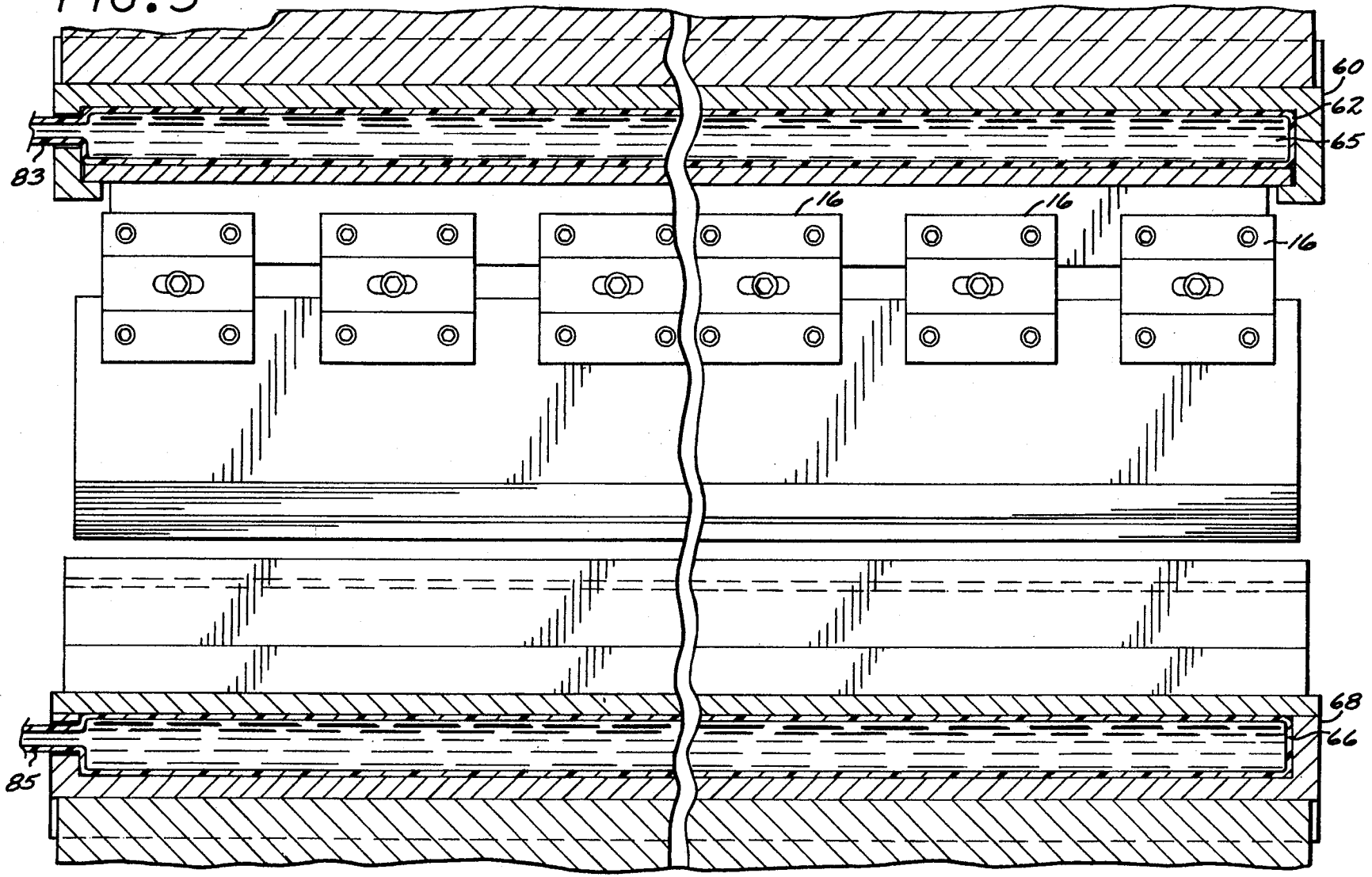
FIG. 5 is a sectional view along line 5—5 of FIG. 4.

FIG. 5 is a sectional view along line 5—5 of FIG. 4 illustrating the elongated nature of the inflatable pressure containers 62 and 66.

Figure 6:
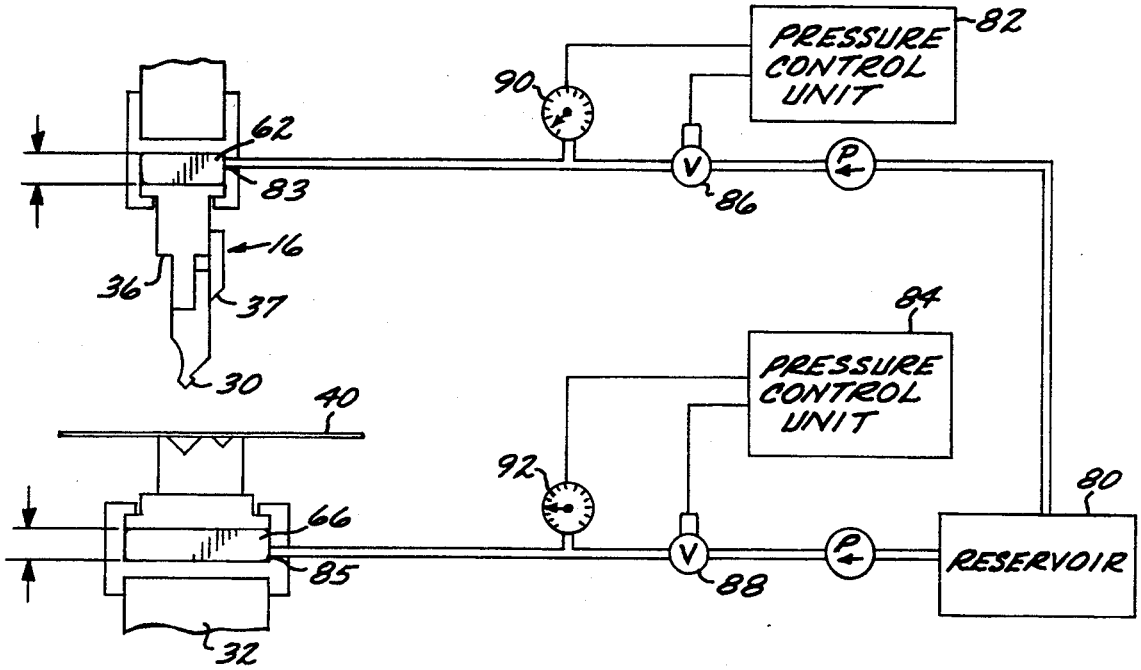
FIG. 6 and 7 are schematic diagrams illustrating the operation of a bending machine with the device of the present invention utilized both in the upper and lower beam portions of the machine.
Figure 7:
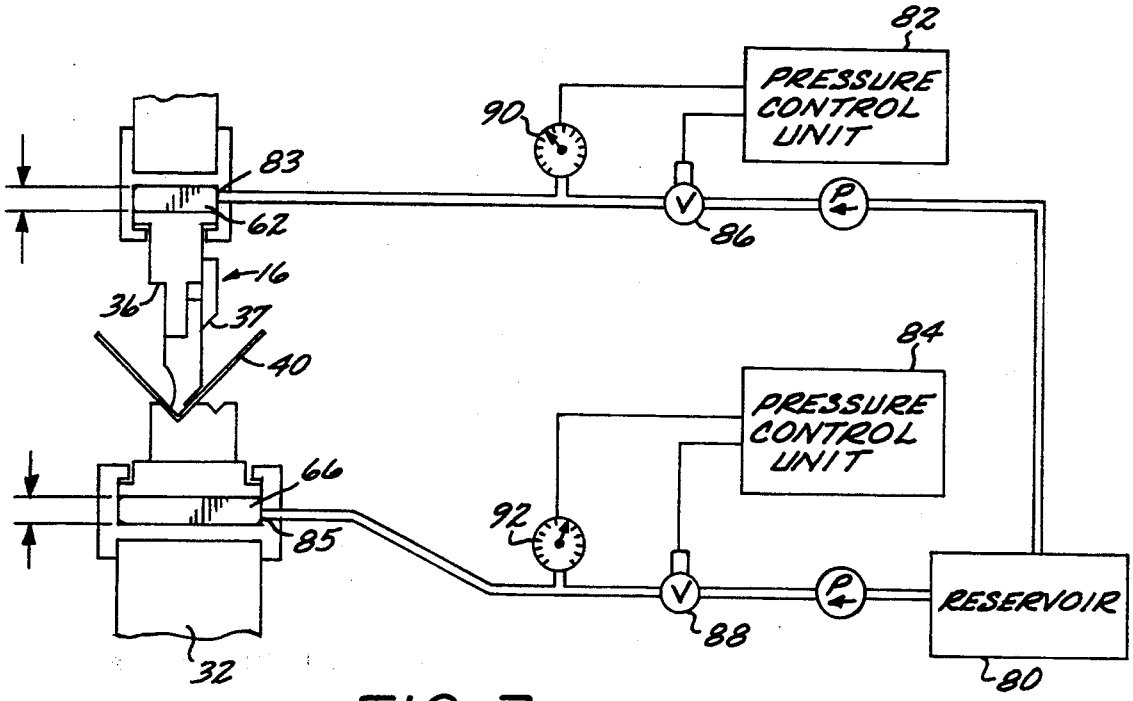

FIGS. 6 and 7 are schematic representations showing how the expandable containers utilized in the FIG. 3 embodiment are controlled. In essence, pressure material, such as hydraulic fluid, stored in reservoir 80 is applied to the expandable containers through pressure control units 82 and 84 and units 83 and 85, respectively, pressure control unit 82 controlling valve 86 and pressure control unit 84 controlling valve 88. An initial reading of the pressure gauges 90 and 92 are shown to illustrate that the initial pressure settings before sheet metal 40 is worked is not necessarily the same.

FIG. 7 represents the situation when the working material 40 is in the process of being bent and also illustrates that the hydraulic fluid pressure to both inflatable containers 62 and 66 have been increased. The actual pressure amounts are controlled to get the optimum uniform pressure distribution illustrated by the representation shown in FIG. 12.

Figure 8:
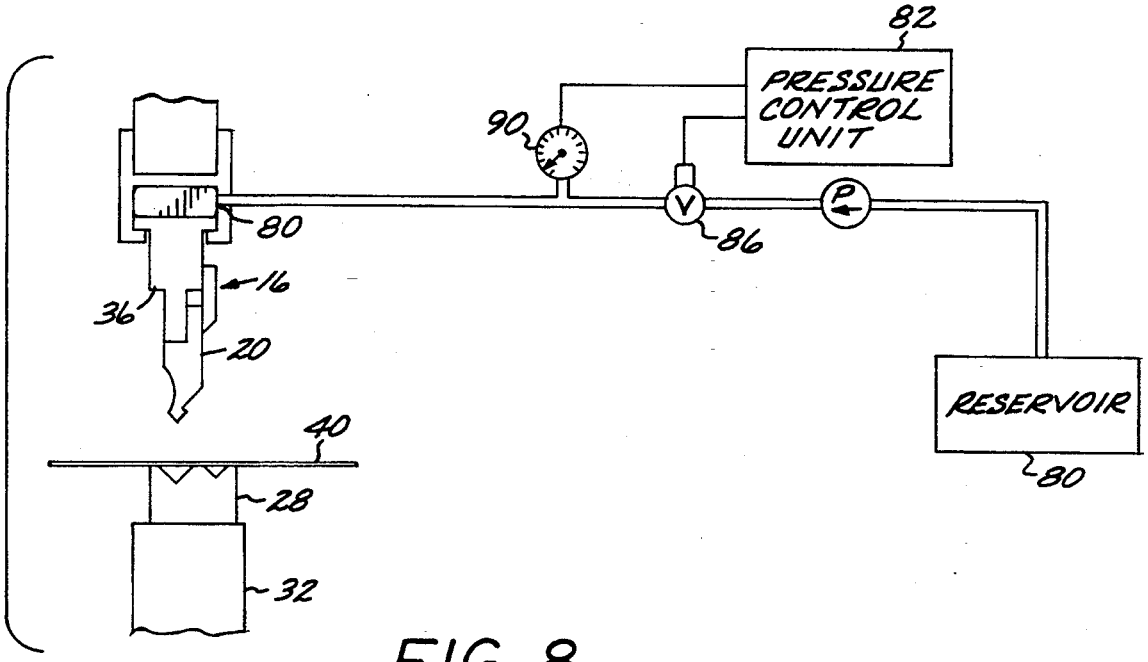
FIG. 8 is a schematic diagram illustrating the operation of a bending machine with the device of the present invention utilized only in the upper beam portion of the machine.
Figure 9:
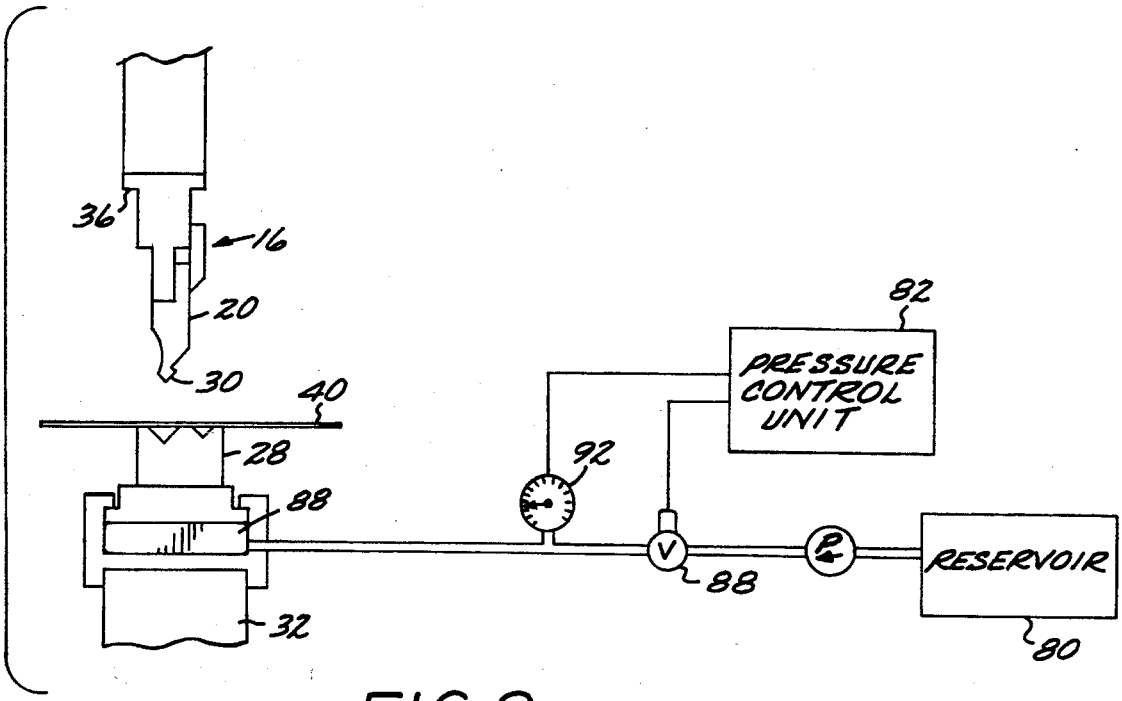
FIG. 9 is a schematic diagram illustrating the operation of a bending machine with the device of the present invention utilized only in the lower beam portion of the machine.

FIG. 8 illustrates an embodiment where an expandable container 80 is utilized only in the upper beam portion 12 adjacent to tool 20 and FIG. 9 represents the situation where an expandable container 88 is only utilized in the lower beam portion 14 below die 28. Although the present invention can be utilized in either one of the three embodiments illustrated, it is preferable that the expandable containers be utilized in both upper and lower beam portions as shown in the FIG. 3 embodiment. Expandable pressure containers 62, 66, 80 and 88 are identical.

FIG. 10 shows an alternate embodiment of the pressure expandable device and in essence comprises an expandable membrane 90 inserted into slots formed in retaining member 92 to form an enclosed container, pressure material 94 being introduced within the container between the lower surface of membrane 90 and the upper surface 96 of the container bottom. The pressure applied to the pressure material 94 is transferred to the adjustable membrane 90 which in turn applies the appropriate force to the die 28 in the manner described previously.

Figure 13:
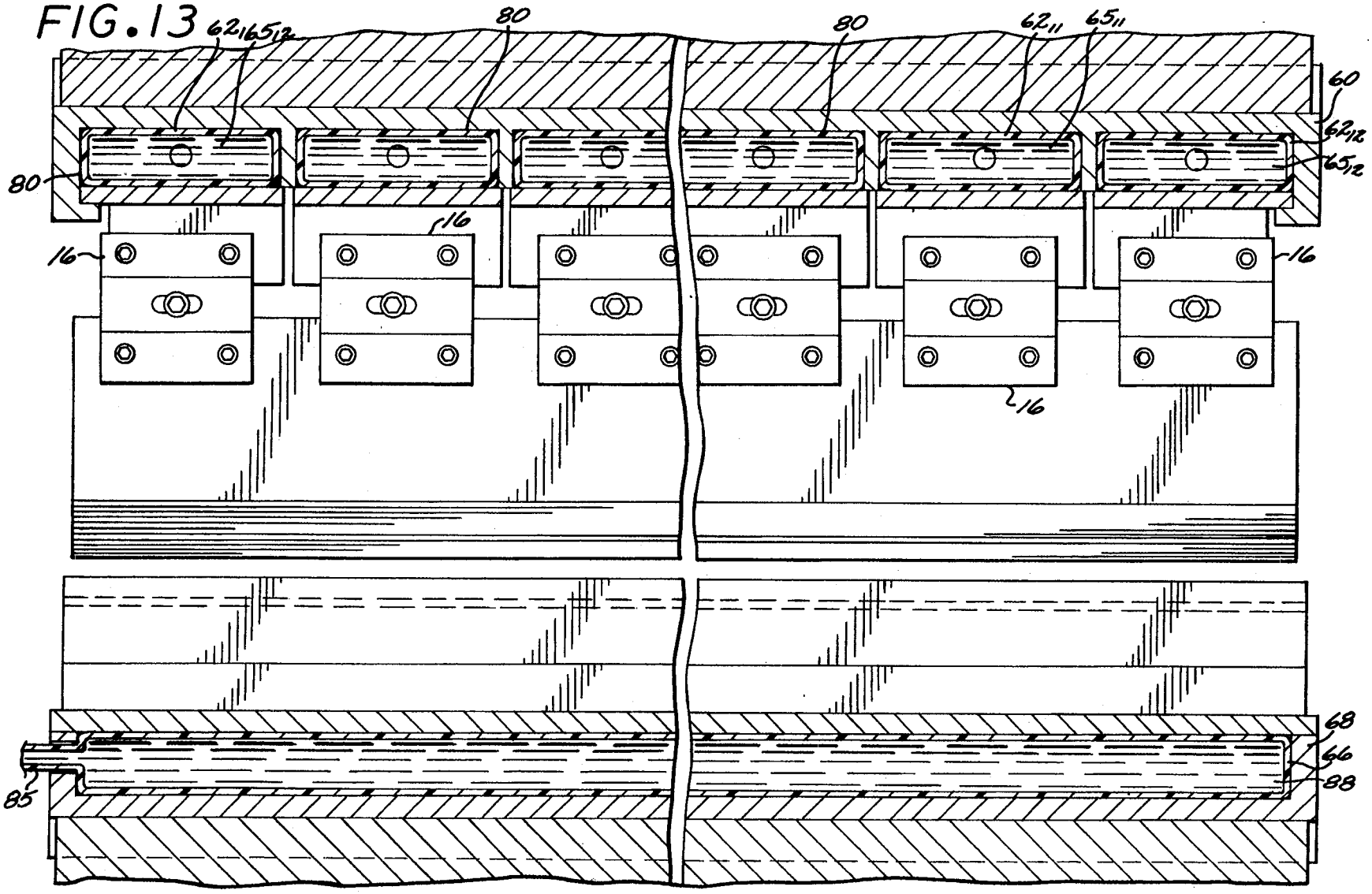
FIG. 13 is a sectional view of a portion of a bending machine using the controlled expandable device of the present invention in an alternate configuration.

FIG. 13 illustrates an embodiment wherein a plurality of expandable containers 80 are utilized in the upper beam portion 12 and an elongated expandable container 88 is utilized in the lower beam portion 14 below die 28. In this embodiment, each distance piece has an expandable container 80 operatively associated therewith to provide an even more accurate bend to the material being worked upon.

Figure 14:
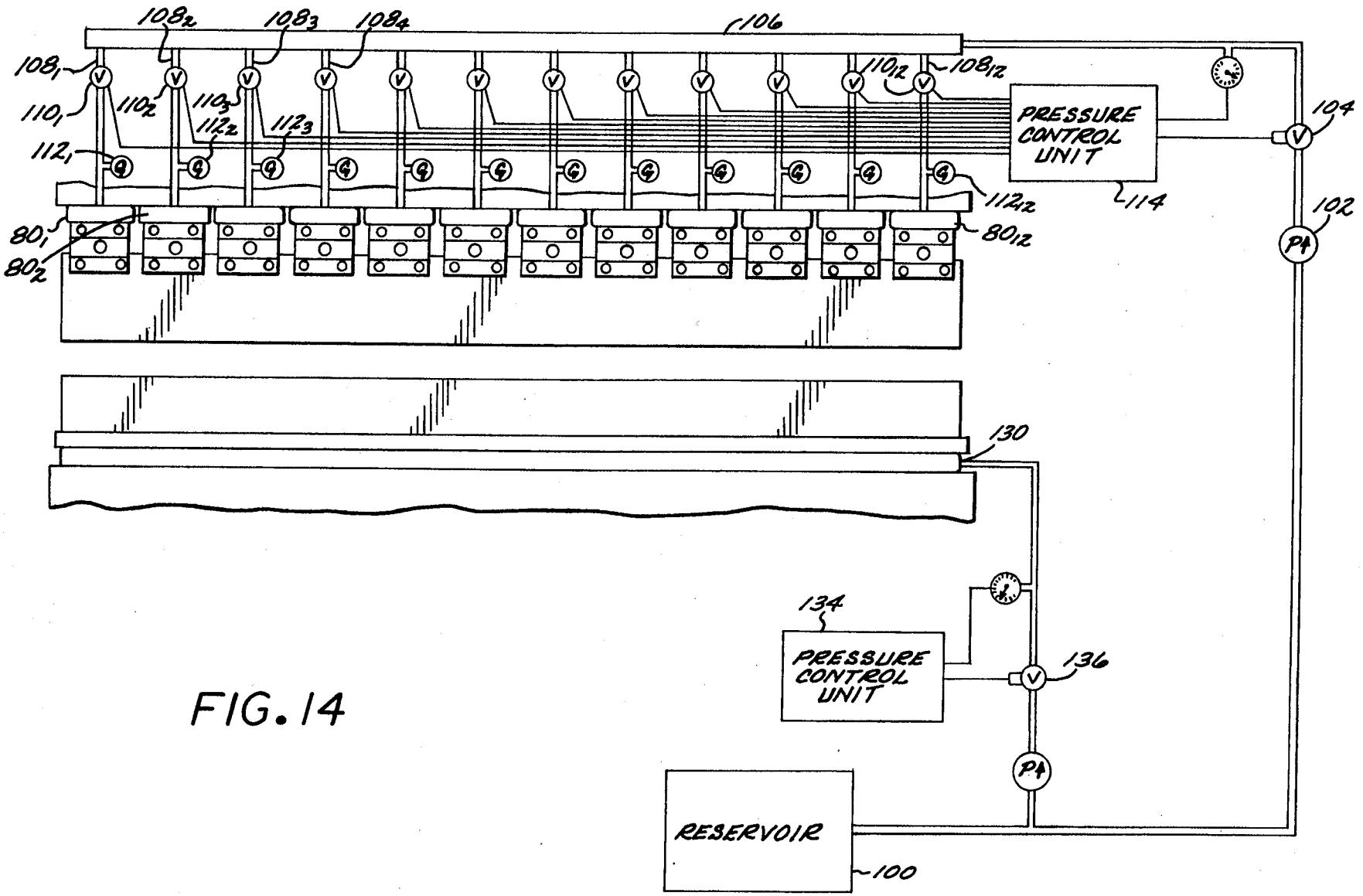
FIG. 14 is a schematic diagram illustrating the operation of the bending machine shown in FIG. 13.

FIG. 14 is a schematic diagram illustrating a system for controlling the bend pressures of the device shown in FIG. 13. Pressure material, such as hydraulic fluid, is stored in reservoir 100 and applied to upper containers 80, $80_2$, $8_3$ . . . $80_{12}$ through pressure gauge 102 and valve 104 to fluid manifold 106. Fluid from manifold 106 is coupled to the individual containers $80_1$, $80_2$ . . . $80_{12}$ through associated lines $108_1$, $108_2$ . . . $108_{12}$. Each fluid line has an associated valve $110_1$, $110_2$ . . . $110_{12}$ and pressure gauge $112_1$, $112_2$ . . . $112_{12}$, the valves 110 being connected to pressure control unit 114 via the indicated control lines. Pressure control unit 114, through various electronic means and micro-controllers, controls the pressure in the individual containers 80 in accordance with the desired bend in the work material. Fluid in reservoir 100 is also coupled to the lower, single, elongated expandable container 130 through line 132, the pressure therein being controlled by pressure control unit 134 which in turn controls valve 136.

The present invention thus provides a technique for modifying existing automated bending machines such that the bending pressure force is evenly distributed throughout the entire material bending length and compensates for bending machine frame distortion that normally would cause the uneven bending pressure distribution and thus eliminate the necessity of distance piece adjustments. The modification can be easily retrofitted into existing machines in a relatively inexpensive manner while providing a bending process which is much more accurate and less labor intensive than heretofore available.

Although the present invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material through the teaching of the invention without departing from its essential teachings.

What is claimed is:

1. In a machine for automatically bending sheet metal to a desired shape, the machine comprising a stationary upper beam portion having a punch mounted therein and a moveable lower beam portion, a die mounted on an upper portion of said lower beam portion, said die having a bottom surface and being positioned to contact said punch, sheet metal being positioned on the die, said lower beam portion being moved towards the punch whereby the sheet metal is bent to the desired shape, the improvement comprising a first elongated pressure device comprising a container having an expandable material for enclosing one side of the container and pressure responsive material within said container and positioned below said die; and means for controlling the pressure of said pressure responsive material whereby the expansion of said expandable material is also controlled, said expandable material applying a substantially uniform pressure to said bottom surface of said die, the die being forced to move toward said punch by the force of said expandable material whereby the pressure applied to the sheet material is uniformly applied during the bending process.

2. The improvement of claim 1 wherein a second elongated pressure device comprising a single, elongated container having an expandable material for enclosing one side of the container, a pressure responsive material within said container, said expandable material being positioned adjacent said punch and further including means for controlling the pressure of said material in said second elongated pressure device.

3. In a machine for automatically bending sheet metal to a desired shape, the machine comprising a stationary upper beam portion having a plurality of punches mounted therein and a moveable lower beam portion, a die mounted on an upper portion of said lower beam portion, said die having a bottom surface and being positioned to contact said punches, sheet metal being positioned on the die, said lower beam portion being moved towards the punches whereby the sheet metal is bent to the desired shape, the improvement comprising a first elongated pressure device comprising a container having an expandable material for enclosing one side of the container and pressure responsive material within said container and positioned below said die; means for controlling the pressure of said pressure responsive material whereby the expansion of said expandable material is also controlled, said expandable material applying a substantially uniform pressure to said bottom surface of said die, the die being forced toward said punch by the force of said expandable material whereby the pressure applied to the sheet material is uniformly applied during the bending process; and a plurality of containers each having expandable materials for enclosing one side of each container, a pressure responsive material within each plurality of containers, the expandable material of each container of said plurality of containers being positioned adjacent corresponding ones of said plurality of said punches.

4. The improvement of claim 3 further including means for controlling the pressure of said material in each of said plurality of containers.

* * * * *